US008323076B1

(12) United States Patent
Bort

(10) Patent No.: US 8,323,076 B1
(45) Date of Patent: Dec. 4, 2012

(54) BACKING PLATE FOR CUT-OFF DISCS

(76) Inventor: Tracey A. Bort, Kirkville, NY (US)

( * ) Notice: Subject to any disclaimer, the term of this patent is extended or adjusted under 35 U.S.C. 154(b) by 823 days.

(21) Appl. No.: 12/456,410

(22) Filed: Jun. 16, 2009

(51) Int. Cl.
*B24B 41/04* (2006.01)

(52) U.S. Cl. ..... 451/342; 451/360; 451/363

(58) Field of Classification Search ..... 451/342, 451/343, 359, 360, 363
See application file for complete search history.

(56) References Cited

U.S. PATENT DOCUMENTS

| | | | | |
|---|---|---|---|---|
| 2,078,120 | A | 4/1937 | Beth | |
| 2,092,978 | A | 9/1937 | Larsson | |
| 2,480,886 | A | 9/1949 | Stever | |
| 2,789,402 | A | 4/1957 | Tocci-Guilbert et al. | |
| 3,241,268 | A | 3/1966 | Olson | |
| D277,486 | S | 2/1985 | Yanagiura | |
| 4,622,783 | A | 11/1986 | König et al. | |
| 4,924,634 | A * | 5/1990 | MacKay, Jr. | 451/342 |
| D444,483 | S | 7/2001 | Sunagawa | |
| 6,749,496 | B2 * | 6/2004 | Mota et al. | 451/546 |
| 6,786,811 | B2 | 9/2004 | Krondorfer et al. | |
| 6,840,849 | B2 * | 1/2005 | MacKay | 451/508 |
| 2007/0141970 | A1 * | 6/2007 | MacKay | 451/510 |

* cited by examiner

*Primary Examiner* — Timothy V Eley
(74) *Attorney, Agent, or Firm* — Bernhard P. Molldrem, Jr.

(57) ABSTRACT

A plastic backing plate for cut-off wheels is herein disclosed, comprising a plastic circular plate which is placed directly behind or under an abrasive cut-off wheel. It is held in place by the wheel and the center nut that is typically used to secure only the cut-off wheel. During use, the backing plate helps to stabilize the cut-off wheel and maintain its shape while turning, thereby providing a more precise and accurate cut. Additionally, since a smaller amount of material is being removed, more material is left behind to perform additional welding on or other machining operations. Also, the life of the cut-off wheel is extended as well, since a reduced amount of cutting is taking place.

18 Claims, 2 Drawing Sheets

BACKING PLATE FOR CUT-OFF DISCS

RELATED APPLICATIONS

The present invention was first described in a notarized Official Record of Invention on Mar. 3, 2008, that is on file at the offices of Montgomery Patent and Design, LLC, the entire disclosures of which are incorporated herein by reference.

FIELD OF THE INVENTION

The present invention relates generally to backing plates for abrasive disks for rotary grinders and, more particularly, to a backing plate for grinding or cutting discs that provides a spacing standoff which enables even and stable grinding and cutting on a flat surface.

BACKGROUND OF THE INVENTION

The proper tool can save time, save money, produce a higher quality job, reduce damage to equipment, and provide for the increased safety of the worker. A cut-off grinder is one common tool seen in many lines of work. They are often used in the construction and metal working industry for cutting various types of metal or even plastics and composite materials as well. The abrasive cutoff wheel wears itself down as it "grinds" through the material. However, such discs tend to vibrate at high RPM's. Such vibration then leads to distortion of the grinding disc which in turn leads to uneven surfaces and excessive material removal. Often times when articles are cut or grinded, the worker must perform the task at an angle due to the fact that the fastening hardware for the abrasive disk does not allow a smooth and flush cut. This excessive material removal means that there is often not enough material left behind to weld, re-weld or perform other machining operations. Additionally there has been difficultly in suitably securing the grinding disks to a backing plate of the cut-off grinder in a manner this withstands the vibrations of heavy grinding operations.

Various attempts have been made to overcome this problem and provide a stable mounting surface for grinding disks. These attempts can be seen by reference to several U.S. Patents. U.S. Pat. No. 2,078,120, issued in the name of Beth and U.S. Patent, issued in the name of Larsson, describe improved grinding disks having mountable disk bodies with a plurality of bonded abrasive sectors and a rigid disk shaped backing plate. U.S. Pat. No. 2,789,402, issued in the name of Tocci-Guilbert et al., describes an improved back plate for supporting abrasive disks for rotary sanders and grinder. U.S. Pat. No. 2,480,886, issued in the name of Stever, describes an abrasive disk support comprising a backing pad for firmly connected the abrasive disk to a rotary tool. U.S. Pat. No. 4,622,783, issued in the name of Konig et al., describes an arrangement for fastening a grinding plate of a grinding apparatus comprising a grinding sheet and clamping elements that are rotatably retained to the grinding disk and the rotary tool, thus enabling the grinding sheet to rotate independently of the grinding disk, which is utilized in the automobile industry for rubbing down automobile bodies. U.S. Pat. No. 6,786,811, issued in the name of Krondorfer et al., describes a grinding machine tool support comprising a tool receptacle and a lock nut slaving device by which an insert tool such as a grinding wheel is operatively connected to the drive shaft of the rotary tool.

Additionally, ornamental designs for grinding wheels and discs exist, particularly, U.S. Pat. Nos. D 277,486 and D 444,483. However, none of these designs are similar to the present invention.

While these devices fulfill their respective, particular objectives, each of these references suffers from one (1) or more of the aforementioned disadvantages. Accordingly, there exists a need for a means by which the above mentioned disadvantages associated with the use of cut-off wheels can be addressed. The development of the present invention substantially departs from the conventional solutions and in doing so fulfills this need.

SUMMARY OF THE INVENTION

In view of the foregoing references, the inventor recognized the aforementioned inherent problems and observed that there is a need for a simple and effective means of connecting an abrasive disk, such as a grinding or cut-of disk, to the shaft of a rotary tool in a manner that provides stability to the disk during high rotary speeds and enables the disk flush contact with a work surface and thus, the object of the present invention is to solve the aforementioned disadvantages and provide for this need.

To achieve the above objectives, it is an object of the present invention to provide a backing plate for cut-off discs that provides an attachment means to a standard four-and-a-half (4½) inch handheld rotary grinder, which enables a user to cut or grind a material evenly while stabilizing and flattening a cut-off disc.

Another object of the backing plate for cut-off discs is to provide a device comprising a spacer, a washer, a backing nut, and a fastener that provides the user with an increased accuracy and improved job quality.

Yet still another object of the backing plate for cut-off discs is to provide a device comprising a spacer adapted to be positioned at a central location on an existing shaft of a grinder, a countersunk washer that is located at a top central location of the spacer, a backing nut that is adapted to be mated to the shaft and abutted against a bottom surface of the spacer, and a fastener that is adapted to be mated to the shaft in such a manner that the fastener remains equidistantly situated subjacent to the spacer. The fastener and the spacer are adapted to intercalate the cut-off disc of the grinder thereby prohibit the cut-off disc from being prematurely offset from a horizontal surface during operation.

Yet another object of the backing plate for cut-off discs is to provide a spacer comprising an aperture that is bored completely through the device that provides a mounting means to slidingly engage a shaft of the grinder, which enables the cut-off disc to be utilized in a parallel and flush location against the material to be cut. The spacer covers a large portion of a top surface of the cut-off disc providing a stabilization means to the cut-off disc.

Yet another object of the backing plate for cut-off discs is to provide a fixed disk-shaped metal washer located at a top central location of the spacer that provides a means to distribute a load from a threaded shaft of the grinder.

Yet another object of the backing plate for cut-off discs is to provide a device that enables a cut-off disc to slidably engage the bottom portion of the device and secured attach via a common backing nut to the shaft of the grinder. The backing nut extends beneath the cut-off disc which preserves the shape of the cut-off wheel while rotating at high speeds and is tightened utilizing a standard spanner wrench that is inserted into spanner apertures.

Yet still another object of the backing plate for cut-off discs is to provide a method of utilizing the device which enables cut-off wheels to function in a more precise and controlled fashion, thus saving material and time in a manner which is quick, easy and effective.

Further objects and advantages of the backing plate for cut-off discs will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | backing plate for cut-off discs |
| 20 | spacer |
| 23 | aperture |
| 25 | washer |
| 27 | backing nut |
| 29 | fastener |
| 31 | spanner aperture |
| 40 | grinder |
| 43 | shaft |
| 45 | securing plate |
| 50 | cut-off disc |

DETAILED DESCRIPTION OF THE PREFERRED EMBODIMENT

Figure 1A:
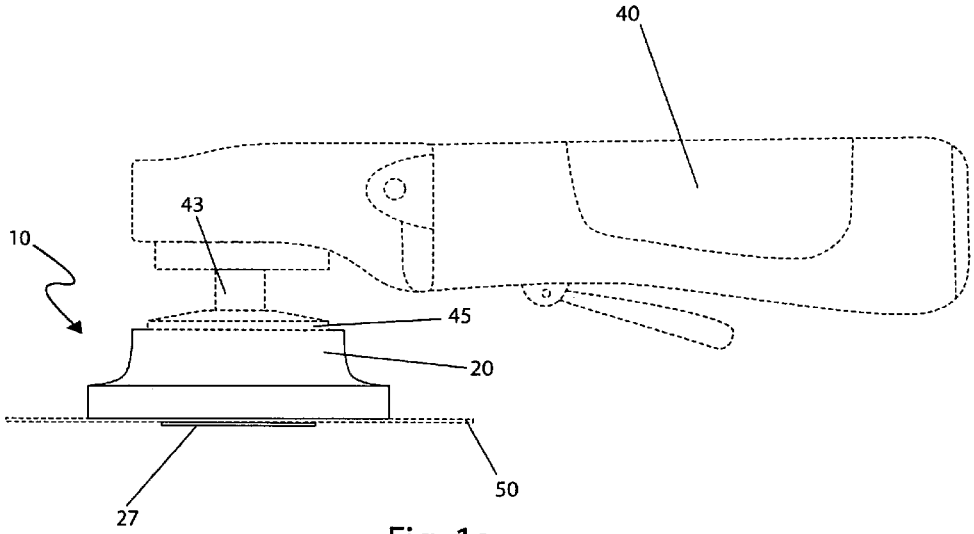
FIG. 1A is an side environmental view of a backing plate for cut-off discs 10 depicting placement thereon a grinder 40, according to a preferred embodiment of the present invention.
Figure 1B:
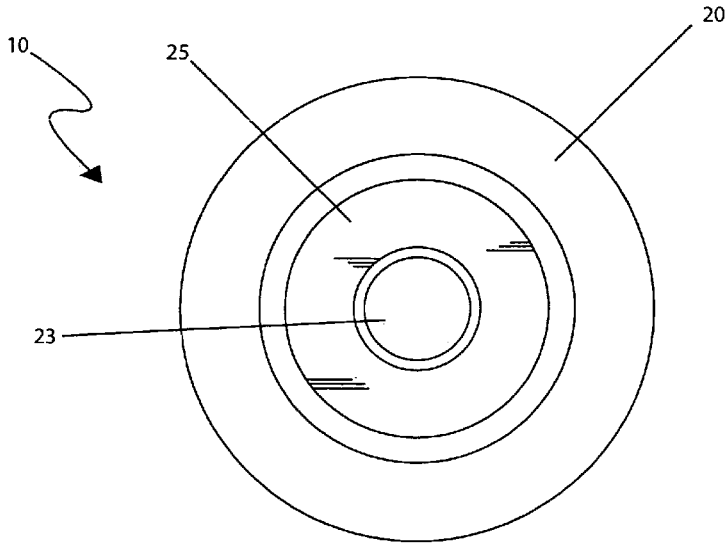
FIG. 1B is a top view of the backing plate for cut-off discs 10, according to a preferred embodiment of the present invention; and, FIG. 2 is a close-up cut-away environmental view of the backing plate for cut-off discs 10, according to a preferred embodiment of the present invention.
Figure 2:
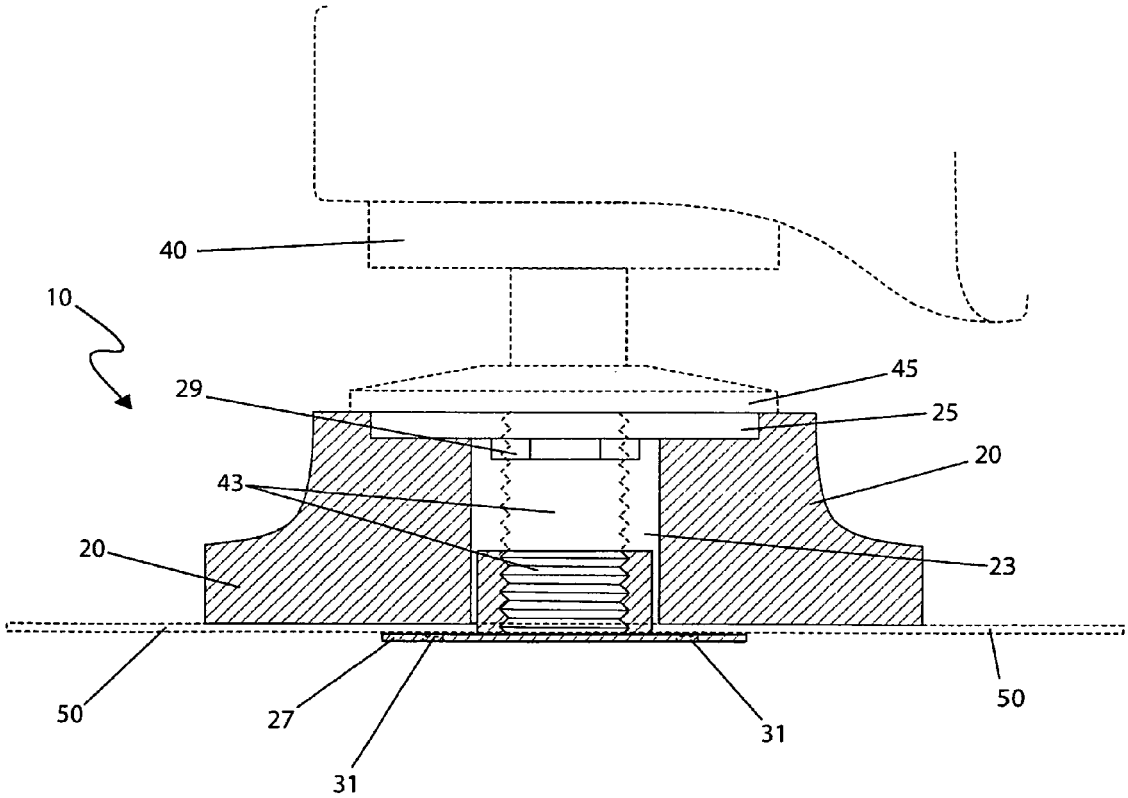

The best mode for carrying out the invention is presented in terms of its preferred embodiment, herein depicted within FIGS. 1 through 2. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a backing plate for cut-off discs (herein described as the "device") 10, which provides an attachment means thereto a standard four-and-a-half (4½) inch handheld grinder 40. The device 10 enables a user to cut or grind a material evenly, thereby stabilizing and flattening a cut-off disc 50. The device 10 comprises a spacer 20, a washer 25, a backing nut 27, and a fastener 29. The device 10 provides the user with an increased accuracy and improved job quality.

Referring now to FIG. 1A, a side environmental view of the device 10 depicting placement thereon a grinder 40, according to the preferred embodiment of the present invention, is disclosed. The device 10 comprises a cylindrical spacer 20 with an approximate height of a half (½) inch. The spacer 20 features an upwardly tapering structure corresponding therewith a securing plate 45 of the grinder 40 and the cut-off disc 50. The spacer 20 encompasses the shaft 43 of the grinder 40 therewith a slidably engaging means, thereby allowing the cut-off disc 50 to be at a location parallel and flush against the material being cut. The spacer 20 covers a considerable portion of the top surface of the cut-off disc 50, thereby providing stabilization thereto the cut-off disc 50 once the grinder 40 is operational (see FIG. 2). The device 10 is preferably envisioned to be fabricated from a plastic material; however other materials maybe used, such as steel, stainless steel, or the like.

Referring now to FIG. 1B, a top view of the device 10, according to the preferred embodiment of the present invention, is disclosed. The spacer 20 comprises an aperture 23 bored completely through the device 10, thereby providing a mounting means to the shaft 43 of the grinder 40. The aperture 23 has an approximate outer diameter of two-and-a-half (2½) inches and an inside diameter slightly greater than the outside diameter of the shaft 43.

The device 10 further comprises a fixed disk-shaped metal washer 25, provided to distribute the load of the threaded shaft 43. The washer 25 is located at a top central location of the spacer 20 (see FIG. 2).

Referring now to FIG. 2, a close-up cut-away environmental view of the device 10, according to the preferred embodiment of the present invention, is disclosed. The device 10 is positioned at a central location thereon the shaft 43 and is attached to a secure position, thereby orienting the washer 25 upward toward the shaft 43 and allowing the device to be fastened with a common threaded hardware fastener 29 such as a hex nut.

The cut-off disc 50 slidably engages the bottom portion of the device 10 and is secured thereby attaching a common backing nut 27 thereto the shaft 43. The backing nut 27 is tightened thereby inserting a standard spanner wrench thereinto the spanner apertures 31. The backing nut 27 extends slightly beneath the cut-off disc 50 which preserves the shape of the cut-off wheel 50 while rotating at high speeds.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIGS. 1 through 2.

The method of utilizing the device 10 may be achieved by performing the following steps: acquiring the device 10; removing any disc retaining hardware if previously installed thereon the grinder 40; inserting the device 10 thereonto the shaft 43 by means of the aperture 23 with the washer 25 oriented toward the securing plate 45; fastening the fastener 29 thereonto the shaft 43 securing the device 10; inserting the cut-off disc 50 thereonto the shaft 43; securing the cut-off disc 50 therewith the backing nut 27; fastening the backing nut 27 thereby inserting a spanner wrench thereinto the spanner apertures 31; cutting materials evenly; and, using the device 10 as needed.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A backing plate for stabilizing and flattening an existing cut-off disc controlled by a grinder, said backing plate comprising:

a spacer adapted to be positioned at a central location on an existing shaft of the grinder, the spacer having a distal face;

a washer located at a top proximal central location of said spacer and being countersunk therein;

a backing nut adapted to be mated to the shaft and abutted against said distal face of said spacer; and, a fastener adapted to be mated to the shaft in such a manner that said fastener remains equidistantly situated subjacent to said spacer;

wherein said backing nut is adapted to hold the cut-off disc of the grinder against the distal face of the spacer and thereby prohibit the cut-off disc from being prematurely offset from a given plane during operating conditions.

2. The backing plate of claim 1, wherein said washer is adapted to be proximally oriented toward the shaft.

3. The backing plate of claim 1, wherein said backing nut is provided with an annular outer flange extending outwardly from a center of said spacer, said annular flange having a spanner aperture formed therealong for assisting a user to tighten and loosen said backing nut.

4. The backing plate of claim 1, wherein said spacer is provided with a tapering structure adapted to correspond with an existing securing plate of the grinder and the cut-off disc respectively.

5. The backing plate of claim 1, wherein said spacer is further adapted to fit over the shaft such that the cut-off disc remains at a location parallel and flush against a material being cut.

6. The backing plate of claim 1, wherein said spacer is further adapted to cover a substantial portion of a proximal surface of the cut-off disc.

7. The backing plate of claim 1, wherein said spacer is formed from a rigid material and has a fixed disk-shape adapted to evenly distribute a load of the shaft.

8. The backing plate of claim 1, wherein said spacer further comprises: an aperture bored completely therein such that said spacer is adapted to receive the shaft of the grinder therethrough.

9. The backing plate of claim 1, wherein said aperture has an approximate outer diameter of 2.5 inches and further has an inside diameter that is adapted to be slightly greater than an outside diameter of the shaft.

10. A backing plate for stabilizing and flattening an existing cut-off disc controlled by a grinder, said backing plate comprising:

a spacer adapted to be securely positioned at a central location on an existing shaft of the grinder, the spacer having a distal face;

a washer located at a proximal central location of said spacer and being countersunk therein, said washer being adapted to be concentrically situated about the shaft;

a backing nut adapted to be threadably mated to the shaft and directly abutted against the distal face of said spacer; and, a fastener adapted to be threadably mated to the shaft in such a manner that said fastener remains equidistantly situated subjacent to said spacer;

wherein said backing nut is adapted to hold the cut-off disc of the grinder against the distal face of the spacer and thereby prohibit the cut-off disc from being prematurely offset from a given plane during operating conditions.

11. The backing plate of claim 10, wherein said washer is adapted to be proximally oriented toward the shaft.

12. The backing plate of claim 10, wherein said backing nut is provided with an annular outer flange extending outwardly from a center of said spacer, said annular flange having a spanner aperture formed therealong for assisting user to tighten and loosen said backing nut.

13. The backing plate of claim 10, wherein said spacer is provided with a tapering structure adapted to correspond with an existing securing plate of the grinder and the cut-off disc respectively.

14. The backing plate of claim 10, wherein said spacer is further adapted to fit over the shaft such that the cut-off disc remains at a location parallel and flush against a material being cut.

15. The backing plate of claim 10, wherein said spacer is further adapted to cover a substantial portion of a proximal surface of the cut-off disc.

16. The backing plate of claim 10, wherein said spacer is formed from a rigid material and has a fixed disk-shape adapted to evenly distribute a load of the shaft.

17. The backing plate of claim 10, wherein said spacer further comprises: an aperture bored completely therein such that said spacer is adapted to receive the shaft of the grinder therethrough.

18. The backing plate of claim 10, wherein said aperture has an approximate outer diameter of 2.5 inches and further has an inside diameter that is adapted to be slightly greater than an outside diameter of the shaft.

* * * * *